United States Patent [19]

Wirth

[11] Patent Number: 4,481,913

[45] Date of Patent: Nov. 13, 1984

[54] HYDRAULIC LASH ADJUSTER OIL METERING BALL VALVE

[75] Inventor: Rick C. Wirth, Alto, Mich.

[73] Assignee: General Motors Corporation, Detroit, Mich.

[21] Appl. No.: 451,006

[22] Filed: Dec. 20, 1982

[51] Int. Cl.[3] ..... F01L 1/24

[52] U.S. Cl. ..... 123/90.35; 123/90.46; 123/90.55

[58] Field of Search ..... 123/90.35, 90.43, 90.46, 123/90.52, 90.55; 137/513.5, 513.3, 513.7, 533.13

[56] References Cited

U.S. PATENT DOCUMENTS

| | | | |
|---|---|---|---|
| 2,296,135 | 9/1942 | Batson et al. | 137/533.13 |
| 2,401,856 | 6/1946 | Brock | 137/533.13 |
| 2,576,687 | 11/1951 | Krehbiel | 137/513.5 |
| 2,761,469 | 9/1956 | Hansen | 137/513.5 |
| 2,954,015 | 9/1960 | Line | 123/90.35 |
| 2,964,027 | 12/1960 | Dadd | 123/90.35 |
| 3,137,282 | 6/1964 | Voorhies | 123/90.35 |
| 3,587,539 | 6/1971 | Dadd | 123/90.35 |
| 3,724,496 | 4/1973 | Secrist | 137/533.13 |
| 3,877,445 | 4/1975 | Barnes | 123/90.35 |
| 4,004,558 | 1/1977 | Scheibe | 123/90.35 |
| 4,184,464 | 1/1980 | Svihlik | 123/90.55 |

FOREIGN PATENT DOCUMENTS

| | | | |
|---|---|---|---|
| 750018 | 8/1933 | France | 137/513.5 |
| 1357080 | 6/1974 | United Kingdom . | |

*Primary Examiner*—Ira S. Lazarus
*Assistant Examiner*—R. S. Bailey
*Attorney, Agent, or Firm*—Arthur N. Krein

[57] ABSTRACT

A hydraulic lash adjuster has a cylindrical body and a hollow plunger slidably received within the body, with the upper portion of the plunger extending beyond the body and it is provided with a semi-spherical thrust end for sliding engagement with a complementary shaped thrust receiving member. The plunger has an internal oil reservoir supplied with oil at a predetermined pressure and the thrust end is provided with a through bore for the flow of oil therethrough to effect lubrication of the thrust surfaces. A metering valve assembly is positioned in the bore and includes a ball valve operatively received in a cup-shaped valve retainer having a clover-shaped aperture in the base, the ball valve cooperating with this aperture to control oil from the reservoir.

2 Claims, 3 Drawing Figures

HYDRAULIC LASH ADJUSTER OIL METERING BALL VALVE

FIELD OF THE INVENTION

This invention relates to a hydraulic lash adjuster, such as used, for example, in an internal combustion engine, for taking up clearance between the thrust transmitting parts in the valve train of the engine and, in particular, to a hydraulic lash adjuster having an improved oil metering valve therein.

DESCRIPTION OF PRIOR ART

When a hydraulic lash adjuster is used, for example, in an overhead cam engine to serve as the fulcrum for the rocker arm in the poppet valve operating train of the engine, it is desirable to provide for oil flow through the thrust member of the lash adjuster to effect lubrication of the bearing surface of the rocker arm and it is desirable to meter this flow with an oil control or metering valve.

Lash adjusters with such metering valves are well-known in the prior art. In one form of such a lash adjuster, the plunger thereof is of a tubular configuration whereby a separate thrust member can be suitably secured therein to permit the installation of a metering valve within the body internally of the plunger. The metering valve is used to control the flow of fluid from a chamber within the plunger through an apertured passage in the thrust member so as to effect lubrication of an associate thrust receiving member that is in operative engagement with the thrust member. Such a thrust receiving member can be either a push rod or a rocker arm.

In order to eliminate the necessity of making the plunger and thrust member as separate elements, a form of metering valve has been used in commercially available lash adjusters which permits the use of a one-piece plunger having the thrust element formed integrally therewith at one end thereof, this form of metering valve being provided with a head and having an elongated shank extending therefrom. This form of metering element is assembled to the plunger by insertion of the shank from the exterior of the plunger into the passage extending through the thrust end of the plunger with the head of the metering valve seating against a suitable valve seat encircling the upper end of the passage in the plunger. Such a metering valve is sometimes referred to as a "jiggle valve".

However, it has recently been discovered that this latter form of metering valve can be forced by oil pressure during engine operation into friction contact with the associate, rocker bearing surface.

SUMMARY OF THE INVENTION

It is therefore a primary object of this invention to provide a hydraulic lash adjuster with an improved metering valve which includes a ball valve loosely received in an apertured valve retainer that is press ftted into the plunger of the lash adjuster for retention therewith.

Another object of this invention is to provide an improved metering valve for a lash adjuster that includes a valve retainer with a ball valve loosely received therein fitted in the plunger of the lash adjuster, the valve retainer having a clover-leaf shaped aperture therein whereby with the ball valve seated thereagainst a predetermined quantity of oil can flow from the plunger to effect lubrication of an associated element.

Still another object of this invention is to provide an improved oil metering valve for use in a hydraulic lash adjuster which is easy to assemble into the apertured plunger of the lash adjuster to a position at which it will be out of frictional contact with an associate thrust receiving member during operation.

For a better understanding of the invention, as well as other objects and further features thereof, reference is had to the following detailed description of the invention to be read in connection with the accompanying drawings, wherein:

Figure 1:
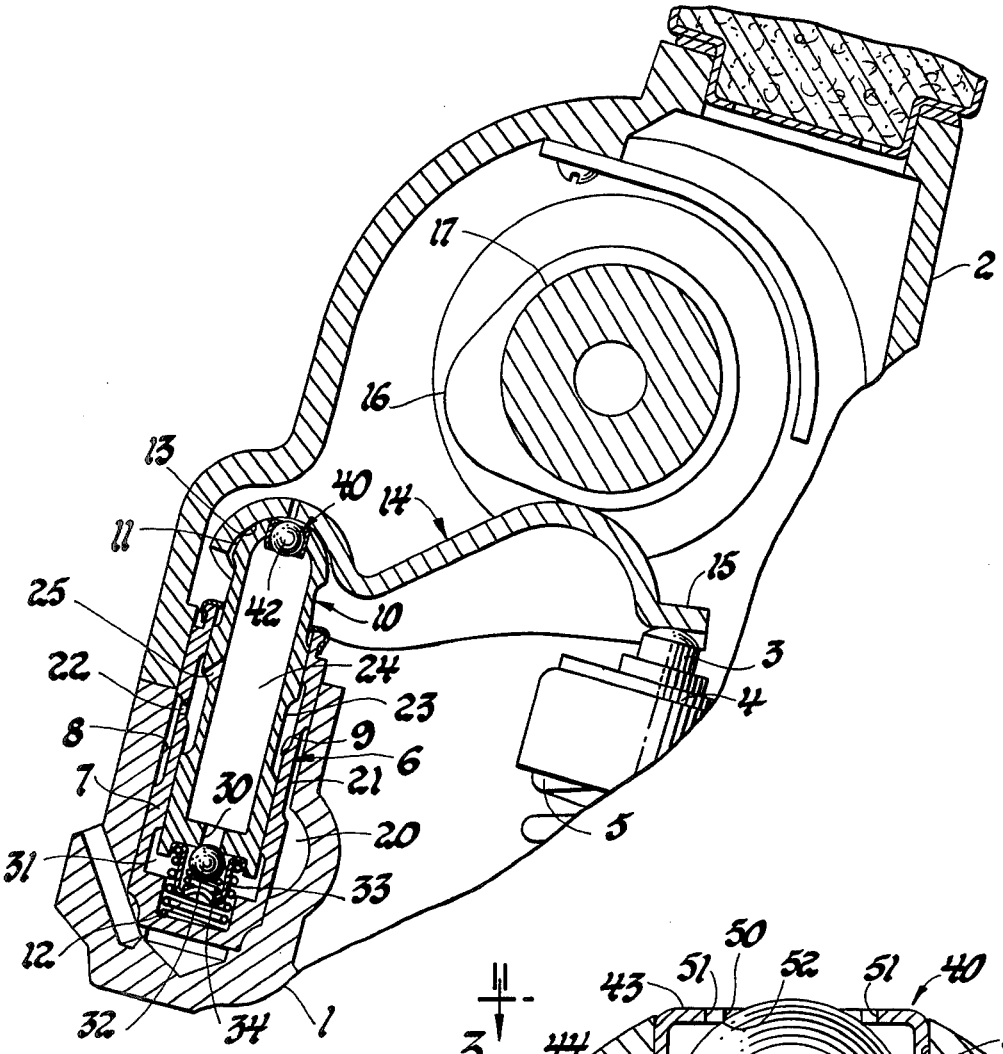
FIG. 1 is a transverse cross sectional view of a portion of an internal combustion engine showing a lash adjuster, having an oil metering valve in accordance with a preferred embodiment of the invention associated therewith, in its installed operating position therein.

Referring now in detail to the drawings, and first to FIG. 1, there is shown portions of an internal combustion engine including a cylinder head 1, to which is suitably affixed a cover 2. Slidably mounted in the head 1 is a conventional poppet valve whose stem upper end is shown at 3. A conventional retainer washer 4 carried by the stem 3 is acted upon by the usual valve return spring 5, tending to elevate the stem to its uppermost position shown. To one side of the valve spring 5 is located an hydraulic valve lash adjuster designated generally by the numeral 6.

The hydraulic lash adjuster 6 includes a generally upright cup or cylindrical body 7 suitably seated in a pocket 8 formed in the cylinder head, this body 7 forming a dashpot for a plunger 10 slidably fitting in the bore 9 of the body 7 with its semi-spherically shaped upper thrust end 11 extending outward from the body to be engaged by the spherically concave end 13 of a rocker arm 14.

A plunger return spring 12 is interposed between the bottom of the body 7 and the lower end of the plunger 10 and acts at all times to bias the plunger 10 upward, with reference to FIG. 1, so as to maintain its engagement with the spherically concave end 13 of the rocker arm 14.

The opposite end 15 of the rocker arm 14 rests on the valve stem end 3, and overlying the rocker and bearing thereagainst intermediate its ends is the usual cam lobe 16 of the engine camshaft 17. It will be appreciated that the camshaft 17 is suitably journaled for rotation and is suitably driven by the engine crankshaft (not shown).

Fluid for the dashpot of the lash adjuster is supplied in the form of oil from the engine lubricating pump (not shown) to a gallery 20 near the bottom of the pocket 8. Communicating at all times with this gallery is an external annular groove 21 on the body 7 which connects with a side port 22 leading into the bore 9 of the body. The plunger 10 likewise has an external groove 23 which communicates with the body side port 22, and connecting this plunger groove 23 with the interior or reservoir 24 of the plunger is a single inlet port 25.

The lower end of the plunger 10 is provided with the usual outlet port 30 by which oil within the oil reservoir 24 of the plunger may flow into the pressure chamber 31 provided between the lower end of the plunger 10 and the internal lower end of the body 7. Such flow is controlled by a check valve 32, in the form of a ball, loosely retained opposite the lower end of the outlet port 30 by a flanged valve cage 33 which, in turn, is held in place against the bottom of the plunger 10 by the previously described plunger return spring 12. The check valve or ball 32 is normally biased towards a seated position relative to the outlet port 30 by means of a valve spring 34 suitably positioned within the valve cage 33.

An axial bore wall 35, of predetermined inside diameter, is provided in the upper portion of the plunger 10, this bore wall 35 defining a passage extending through the upper, semi-spherical thrust end 11 of the plunger to enable oil within the reservoir 24 to lubricate the end 13 of the rocker arm 14.

In accordance with the subject invention, the flow of oil from the reservoir 24 in the plunger 10 out through the passage defined by the bore wall 35, to effect lubrication of the opposed bearing surfaces of the thrust end 11 of the plunger 10 and rocker arm 14, is controlled by a metering valve assembly 40 that includes a valve retainer 41 with a ball valve 42, of predetermined diameter, operatively supported therein. Preferably, for parts uniformity, both the ball valve 42 and the check valve 32 are of the same nominal diameters as shown in FIG. 1.

As illustrated, the valve retainer 41 is of inverted cup shape and of predetermined axial extent with a base 43 having a cylindrical collar 44 depending therefrom, the lower free end of this collar being radially turned in whereby to define an annular retainer flange 45 to effect retention of the ball valve 42 in one axial direction. Accordingly, the predetermined internal diameter of the retainer flange 45 is smaller than the outside diameter of the ball valve 42.

Figure 2:
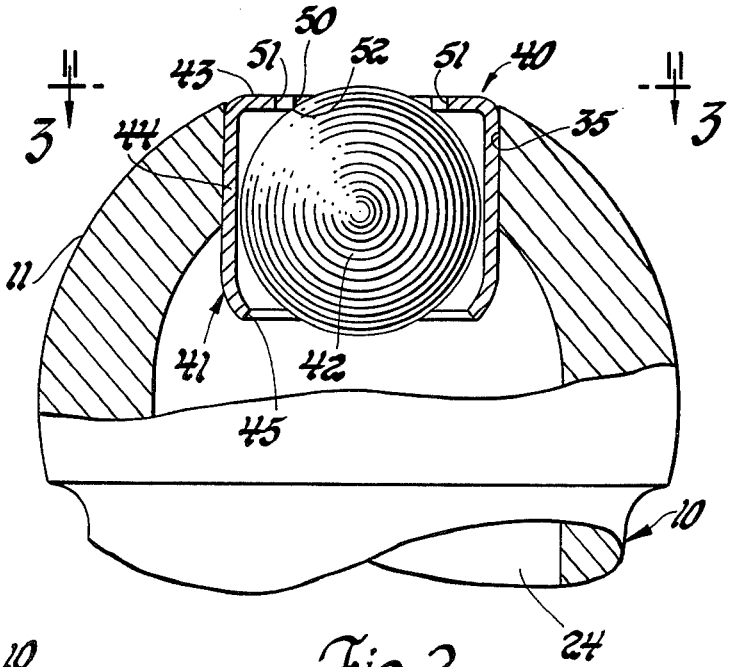
FIG. 2 is an enlarged view of a portion of the hydraulic lash adjuster of FIG. 1 with the oil metering valve therein.
Figure 3:
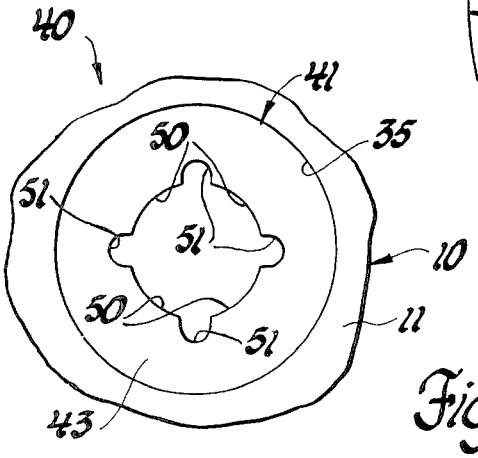
FIG. 3 is a top view of the lash adjuster and cap retainer, per se, of the metering valve assembly of FIGS. 1 and 2, taken along line 3—3 of FIG. 2.

As best seen in FIG. 3, the base 43 of the valve retainer 41 is provided with a central, clover leaf shaped aperture defined by a segmented, generally circular wall 50 of a predetermined mean inside diameter that is less than the outside diameter of the ball valve 42 and, in the construction shown, by a plurality of circumferentially equally spaced apart flutes 51 each of which extend radially outward relative to adjacent wall 50 segments, four such flutes being used in the embodiment illustrated. As best seen in FIG. 2, the lower edge of the segmented wall 50 defines a valve seat 52 for the ball valve 42.

The number of flutes 51 and their cross-sectional area are preselected for a particular engine application whereby these flutes are operative to permit the restricted flow of oil from the reservoir 24, as desired, when the ball valve 42 is seated against the valve seat 52 during engine operation, the position of the ball valve 42 shown in FIGS. 1 and 2.

The outside diameter of the collar 44 is sized so that it can be inserted into the bore wall 35 of the plunger 10 and suitably secured therein. In the construction illustrated, the collar 44 is sized relative to the inside diameter of the bore wall 35 whereby it is secured therein by a press fit.

As best seen in FIG. 2 the inside diameter of the collar 44 and the axial extent between the base 43 and annular flange 45 are preselected, as desired, whereby the ball valve 42 is loosely movable both axially and radially within the valve retainer 41.

Preferably the metering valve assembly 40 is axially positioned in the bore wall 35 of the plunger 10 so that, when the ball valve 42 is seated against the valve seat 52 the position shown in FIGS. 1 and 2, both the valve retainer 41 and ball valve 42 are located so as to be out of contact with the opposed bearing surface in the concave end 13 of the rocker arm 14. That is, neither the valve retainer 41 nor ball valve 42 are positioned so as to project above the extended arcuate plane of the exterior surface of the thrust end 11 of plunger 10.

However, with the metering valve assembly 40 thus fixed in the bore 35 of plunger 10, its presence can still be visually ascertained by a mechanic during the assembly of such a lash adjuster 6 in an engine.

While the invention has been described with reference to a particular embodiment disclosed herein, it is not confined to the details set forth since it is apparent that various modifications can be made by those skilled in the art without departing from the scope of the invention. This application is therefore intended to cover such modifications or changes as may come within the purposes of the invention defined by the following claims.

The embodiments of the invention in which an exclusive property or privilege is claimed are defined as follows:

1. In a hydraulic lash adjuster including a cylindrical outer dashpot body, a hollow plunger telescopically received in said dashpot body with a free end thereof extending axially outward from said dashpot body, said free end having a semispherical reaction surface with a central axial passage extending therethrough, the improvement including a cup-shaped retainer fixed in said passage, said retainer having a base portion next adjacent to said reaction surface with a clover-leaf shaped aperture therein; and, a ball valve operatively supported in said retainer, said clover-leaf aperture including a generally circular portion of a mean diameter less than the outside diameter of said ball valve so as to define a seat for said ball valve and, a plurality of circumferentially spaced apart flutes extending radially outward of said circular portion said flutes being a predetermined cross-sectional area for the predetermined restricted flow of lubricant from said plunger when said ball valve is seated against said seat.

2. In a hydraulic lash adjuster including a cylindrical outer dashpot body, a hollow plunger telescopically received in said dashpot body with a free end thereof extending axially outward from said dashpot body, said free end having a semi-spherical reaction surface with a central axial passage extending therethrough, the improvement including a ball valve operatively supported in a retainer axially fixed in said passage to control oil flow therethrough, said retainer including a base portion next adjacent to said reaction surface, a cylindrical collar depending from said base portion and a retainer flange extending radially inward from the free end of said collar whereby said ball valve is operatively supported in said retainer, said base portion having a central clover-leaf shaped aperture therein defined by generally circular portions of a mean diameter less than the outside diameter of said ball valve so as to define a seat for said ball valve and, a plurality of circumferentially spaced apart flutes extending radially outward of said circular portions said flutes being of a preselected cross-sectional area for the predetermined restricted flow of lubricant from said plunger when said ball valve is seated against said seat.

* * * * *